US006225899B1

(12) United States Patent
Yoshida

(10) Patent No.: US 6,225,899 B1
(45) Date of Patent: May 1, 2001

(54) CDT DATA TRANSMISSION METHOD

(75) Inventor: Jun Yoshida, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/036,690

(22) Filed: Mar. 9, 1998

(30) Foreign Application Priority Data

Mar. 18, 1997 (JP) ..... 9-083448

(51) Int. Cl.[7] ..... G08B 29/00
(52) U.S. Cl. ..... 340/506; 340/825.06; 340/825.14
(58) Field of Search ..... 340/506, 531, 340/534, 825.06, 825.14

(56) References Cited

U.S. PATENT DOCUMENTS 5,400,246 * 3/1995 Wilson et al. ..... 340/825.08

FOREIGN PATENT DOCUMENTS 62-2742 1/1987 (JP) .
1-300641 12/1989 (JP) .
5-83212 4/1993 (JP) .

* cited by examiner

*Primary Examiner*—Daryl Pope
(74) *Attorney, Agent, or Firm*—Young & Thompson

(57) ABSTRACT

Efficient CDT transmission is enabled by constructing an output conversion table of cyclic data transfer (CDT) so as to allow free alteration of settings.

Alarms collected from a monitored device at monitoring device 20 of slave station 2 are converted to message data at external interface 23. The converted message data are compared with CDT output conversion table 23 at table comparison section 22 to determine output word positions. The content of CDT output conversion table 24 is set by table setting section 26, whereby additions or alterations can be effected as necessary. The data of the results of comparison by table comparison section 22 are transmitted to the master station 1 from CDT transmitter 21. The CDT words transmitted from CDT transmitter 21 are determined by means of output word stipulation section 27, and output word stipulation section 27 sets transmission words by referring to CDT output conversion table 24.

6 Claims, 4 Drawing Sheets

Fig. 2 Prior Art

| word | bit | alarm message |
|---|---|---|
| 1 | 1<br>2<br>3<br>⋮<br>13 | |
| 2 | 1<br>2<br>3<br>⋮<br>13 | |
| 3 | 1<br>2<br>3<br>⋮<br>13 | |
| ⋮ | ⋮ | |
| 64 | 1<br>2<br>3<br>⋮<br>13 | |

| alarm message | CDT output position | |
|---|---|---|
| | word | bit |
| AAAAAAAAAAAAAAAAAAAA | 1 | 1 |
| BBBBBBBBBBBBBBBBBBBB | 1 | 1 |
| CCCCCCCCCCCCCCCCCCCC | 1 | 1 |

| alarm message | CDT output position | |
|---|---|---|
| | word | bit |
| AAADDDEEEEEEEEEEEEEE | 1 | 1 |
| BBBDDDEEEEEEEEEEEEEE | 1 | 1 |
| CCCDDDEEEEEEEEEEEEEE | 1 | 1 |

| | | |
|---|---|---|
| ***DDDEEEEEEEEEEEEEE | 1 | 1 |

CDT DATA TRANSMISSION METHOD

BACKGROUND OF THE INVENTION

1. Field of the Invention

The present invention relates to a data transmission system in a cyclic digital transmission used in a monitoring station.

2. Description of the Related Art

FIG. 1 shows the structure of a monitoring system that communicates alarm data by means of this type of cyclical data transmission (hereinbelow abbreviated CDT) of the prior art. In FIG. 1, the monitoring system is made up of monitoring device 10 established at master station 1, monitoring device 20 established at slave station 2, and the circuit connecting the monitoring devices.

An alarm from a monitored device that is collected within slave station 2 is converted to message data at external interface 23 of monitoring device 20 and sent to table comparison section 22. Table comparison section 22 compares message data sent from external interface 23 with CDT conversion table 24 and determines the word position in the assembly destination of alarm data.

In CDT conversion table 24, message data are pre-defined by each word position in an assembly destination of alarm data. FIG. 2 shows the format of the CDT conversion table. The CDT conversion table indicates by the numerical values of words and bits the CDT output positions in an assembly destination corresponding to message data of an alarm, and holds the combinations of all words and bits.

Monitoring device 20 then transmits alarm data of the determined word positions from CDT transmitter 21 to CDT receiver 11 of monitoring device 10 established at master station 1. Fundamentally, the total number of words of a one-cycle portion (for example, 64 words, one word being made up of 13 bits) of alarm data are always outputted, but the number of output words can be altered by using output word setting section 25 to pre-set the number of words in one cycle.

This transmission of information between a master station and slave station by means of this type of CDT is always carried out cyclically, and assembly for CDT is carried out by basing the assembly of CDT output words on a fixed CDT conversion table in which assembly words are pre-defined for each item of message data of an alarm, and by always referring to the entire table for all words (64 words). The conversion process is therefore time-consuming, and as a result, there is the problem that recognition of the generation of an alarm is delayed at the master station, i.e., the host center monitoring device.

In monitoring systems of the prior art, the table must be rewritten for all words on the transmitting side and receiving side in cases of the addition or deletion of data of a table designating assembly words, such addition or deletion commonly accompanying increases or decreases in collected alarms. In monitoring systems of the prior art, moreover, in cases in which there are fewer categories of collected alarms than the total number of CDT output words per circuit, words are outputted for which no definition exists, resulting in the transmission of superfluous words. Although the number of output words can be altered by means of output word setting section 25, this modification must be effected in advance.

SUMMARY OF THE INVENTION

The object of the present invention is to provide an efficient CDT data transmission system that enables both reduction of the number of items of table data in a CDT output conversion table as well as free setting of the addition or deletion of table data in word units.

The present invention includes a means that can make additions or deletions to the table for assembling to CDT an alarm collected from a monitored device in units of the content of each alarm message by designating word positions corresponding to message content; wherein this means, when comparing the table with collected alarm messages and determining output word positions, adds designations that are not to be compared with alarm messages to message data within table data, and in addition, determines words that are to be transmitted from word positions defined in the table.

The present invention provides a table setting section that produces a CDT output conversion table that designates word positions corresponding to an alarm message, and enables the flexible alteration or updating of alarm data in accordance with the increase or decrease of alarms collected from a monitored device by adding to or deleting from the CDT output conversion table only relevant alarm data and without updating data for all words. In addition, the present invention can, according to necessity, degenerate an alarm message or simultaneously degenerate an alarm message and reduce the number of items of table data that are to be compared.

In addition, because output word positions of data that are set in the CDT output conversion table are consulted and only words that are designated as output word positions are set in CDT transmitter 21, the present invention can prevent the transmission of,unnecessary words, thereby enabling more efficient CDT data transmission.

The above and other objects, features, and advantages of the present invention will become apparent from the following description with references to the accompanying drawings which illustrate an example of the present invention.

BRIEF DESCRIPTION OF THE DRAWINGS

FIG. 2 shows the format of a CDT output conversion table used in a CDT data transmission system of the prior art;

DETAILED DESCRIPTION OF THE PREFERRED EMBODIMENTS

Figure 1:
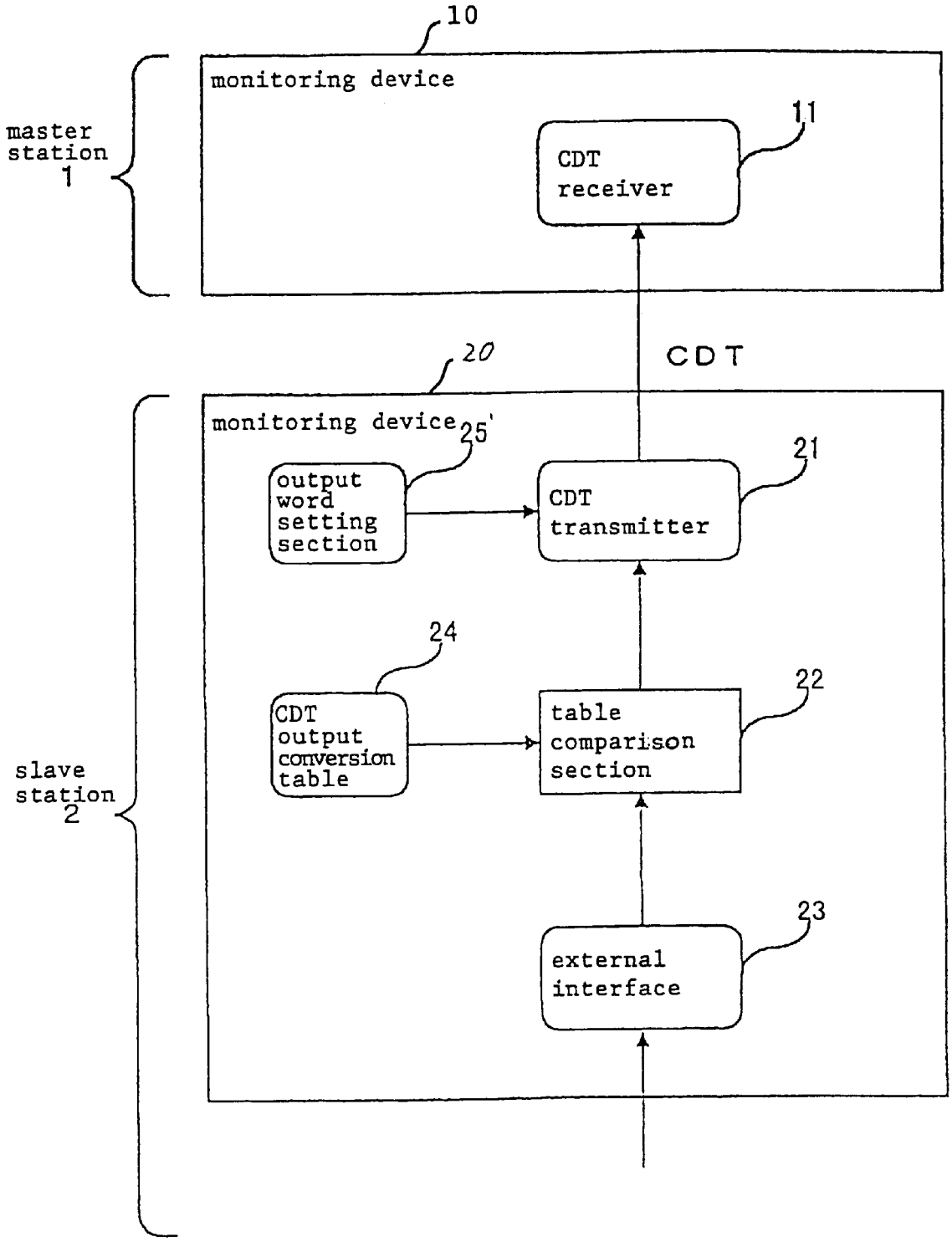
Fig. 1 Prior Art
FIG. 1 is a block diagram showing an example of a CDT data transmission system of the prior art.
Figure 3:
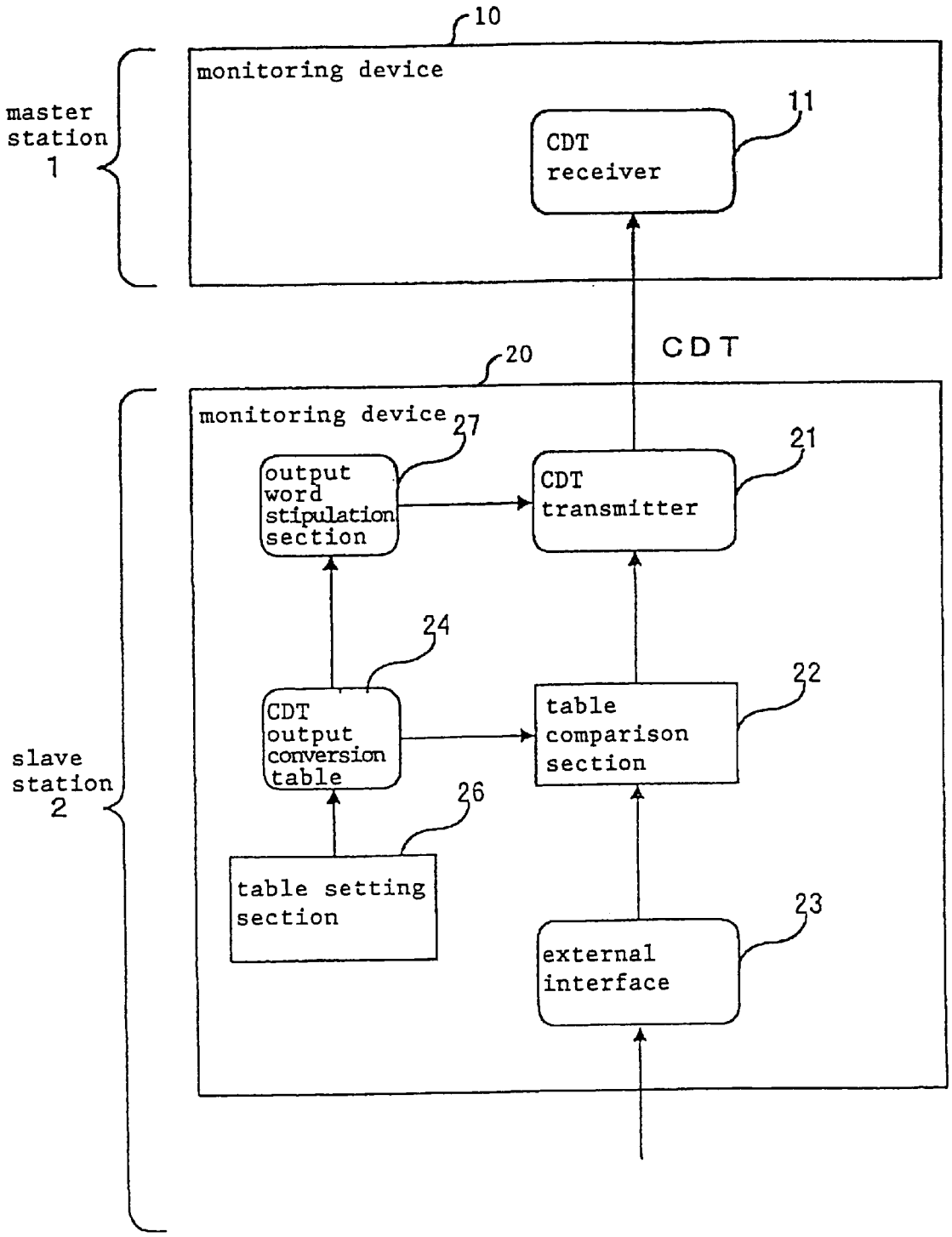
FIG. 3 is a block diagram showing an embodiment of the CDT data transmission system according to the present invention.

FIG. 3 is a block diagram showing an embodiment of a monitoring system according to the present invention. The points of difference between the monitoring system of the present invention shown in FIG. 3 and the prior-art system shown in FIG. 1 are the provision of table setting section 26 that sets CDT output conversion table 24 which in turn designates word positions corresponding to the content of an alarm message; and output word stipulation section 27 that determines words that effect CDT output in tandem with the set state of the CDT output conversion table. Constituent elements that are equivalent to those of the prior-art system shown in FIG. 1 are identified by the same reference numerals.

In FIG. 3, a monitoring system is constructed from monitoring device 10 established at master station 1 and monitoring device 20 established at slave station 2;

monitoring device 10 and monitoring device 20 are connected by a circuit between them; and alarms collected at slave station 2 are communicated to master station 1 by means of CDT.

Alarms collected from the monitored device at monitoring device 20 are converted to message data at external interface 23. The converted message data are compared with CDT output conversion table 24 at table comparison section 22 to determine the output word positions. The content of CDT output conversion table 24 is set by table setting section 26, thereby allowing the appropriate addition or deletion of table data as necessary.

As shown in FIG. 2, table data that are set by means of table setting section 26 are of a format that indicates both message data of alarms that are sent from external interface 23 and CDT output position data that designate the word positions that are assembled as CDT output. Table data that are set by means of table setting section 26 are added to CDT output conversion table 24 in units of each type of message data.

Here, the CDT data transmission system of the present invention deals with a plurality (in this case, three) of message data items AAA---AA, BBB---BB, and CCC---CC by designating the same assembled word position (CDT output positions) for each, thereby degenerating message data for a plurality of alarms to one CDT output position.

Figures 4, 5:
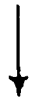
FIG. 4 is an explanatory view showing the degeneration of a plurality of message data items of a CDT output conversion table data and designation to the same CDT output word positions according to the present invention.
FIG. 5 is an explanatory view showing the limitation of the objects of comparison by excluding from comparison the differing portions within each message in a case in which a plurality of message data items of CDT output conversion table data are degenerated to the same word in the present invention.

However, the CDT data transmission system of this invention still requires table data for all of the types of message data, and when table data become voluminous, comparison of CDT output conversion table with message data and subsequent conversion can become time-consuming. The present invention enables a further reduction in the number of items of table data by designating only shared portions within a message as objects of comparison. As shown in the example in FIG. 5, to degenerate the differing items of alarm message data AAADDDEEE-EE, BBBDDDEEE-EE, CCCDDDEEE-EE to one CDT output position, the portion shared by these three items of alarm message data "DDDEEE-EE" is taken as message data and the differing portions "AAA", "BBB", and "CCC" are designated as items to be excluded from comparison, thereby making the three alarm messages a single table [entry], and degenerating a plurality of items of alarm message data to one CDT output position.

By means of the results of comparison at table comparison section 22, an alarm is transmitted from CDT transmitter 21 to CDT receiver 11 established in monitoring device 10 of master station 1. The CDT words transmitted from this CDT transmitter 21 are determined by output word stipulation section 27. Output word stipulation section 27 determines output words based on the table data defined in CDT output conversion table 24. In other words, output word stipulation section 27 refers to the output word positions of data set by the table [entries] in CDT output conversion table 24 and sets in CDT transmitter 21 only the words designated as output word positions.

Instead of outputting all words of a one-cycle portion, CDT transmitter 21 communicates alarms by transmitting as one cycle to the master station 1 side only the words set by output word stipulation section 27.

In addition, an equivalent CDT output conversion table and table setting section are also provided on the master station side, and a CDT output conversion table is produced to match that of the slave station side. As a result, message data are obtained from a one-cycle portion of CDT data that are composed of words sent from the slave station side and set by output word stipulation section 27, and alarm recognition is effected based on this message data.

While a preferred embodiment the present invention has been described using specific terms, such description is for illustrative purposes only, and it is to be understood that changes and variations may be made without departing from the spirit or scope of the following claims.

What is claimed is:

1. A CDT data transmission system in a monitoring station that communicates alarm data by cyclical data transmission, comprising:

a monitoring device established in a slave station that includes a message converter that converts alarms collected from a monitored device into message data;

a table producer that produces a table that designates CDT output word positions corresponding to alarm message data, and generates a plurality of message data items by designating the message data items to the same CDT output word position; and a table comparator that compares messages that are to be compared within table data and determines output word positions;

a monitoring device established in the master station; and a circuit connecting these monitoring devices.

2. A CDT data transmission system according to claim 1 wherein said table producing means comprises:

an output word determiner that determines words to be transmitted to a master station from output word positions that are set in a produced table; and a CDT transmitter that transmits determined words to a master station.

3. A CDT data transmission system in a monitoring station that communicates alarm data by cyclical data transmission, comprising:

monitoring device established in a slave station that includes a message converter that converts alarms collected from a monitored device into message data;

a table producer that produces a table that designates CDT output word positions corresponding to alarm message data, and in a case in which a plurality of message data items are generated to the same word, excludes mutually differing portions within each message from those objects that are to be compared; and a table comparator that compares messages that are to be compared within table data and determines output word positions;

a monitoring device established in the master station; and a circuit connecting these monitoring devices.

4. A CDT data transmission system according to claim 3 wherein said table producing means comprises:

an output word determiner that determines words to be transmitted to a master station from output word positions that are set in a produced table; and a CDT transmitter that transmits determined words to a master station.

5. A CDT data transmission system in a monitoring station that communicates alarm data by cyclical data transmission, comprising:

monitoring device established in a slave station that includes a message converter that converts alarms collected from a monitored device into message data;

a table producer that produces a table that designates CDT output word positions corresponding to alarm message data, and generates a plurality of message data items by designating the message data items to the same CDT output word position, and in a case in which a plurality of message data items are generated to the same word, excludes mutually differing portions within each message from those objects that are to be compared; and a table comparator that compares messages that are to be compared within table data and determines output word positions;

a monitoring device established in the master station; and a circuit connecting these monitoring devices.

6. A CDT data transmission system according to claim 5 wherein said table producing means comprises:

an output word determiner that determines words to be transmitted to a master station from output word positions that are set in a produced table; and a CDT transmitter that transmits determined words to a master station.

* * * * *